US008684091B2

(12) United States Patent
Ezell et al.

(10) Patent No.: US 8,684,091 B2
(45) Date of Patent: Apr. 1, 2014

(54) WELLBORE SERVICING COMPOSITIONS AND METHODS OF MAKING AND USING SAME

(75) Inventors: Ryan G. Ezell, Spring, TX (US); Douglas J. Harrison, Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 13/455,019

(22) Filed: Apr. 24, 2012

(65) Prior Publication Data

US 2012/0205110 A1 Aug. 16, 2012

Related U.S. Application Data

(62) Division of application No. 12/554,707, filed on Sep. 4, 2009, now Pat. No. 8,322,431.

(51) Int. Cl.
*E21B 33/00* (2006.01)

(52) U.S. Cl.
USPC ..... 166/363; 166/90.1; 507/200

(58) Field of Classification Search
USPC ..... 166/344, 338, 351, 352, 361, 363, 364, 166/367, 368, 270, 277, 301; 405/184.1; 137/15.12, 317, 318; 507/200, 903
See application file for complete search history.

(56) References Cited

U.S. PATENT DOCUMENTS 2,837,163 A * 6/1958 Ramos et al. ..... 166/250.03
2,840,166 A * 6/1958 Eckel et al. ..... 166/55
3,144,049 A * 8/1964 Ginsburgh ..... 138/97
3,208,524 A * 9/1965 Horner et al. ..... 166/294
3,647,000 A * 3/1972 Rowley et al. ..... 166/285
3,717,202 A * 2/1973 Burrow ..... 166/55
3,738,424 A * 6/1973 Osmun et al. ..... 166/298
3,821,965 A * 7/1974 Reynolds ..... 137/318
3,926,256 A * 12/1975 McCall ..... 166/285
3,967,681 A * 7/1976 Curzon ..... 166/277
4,040,484 A * 8/1977 Hessert ..... 166/294
4,252,465 A * 2/1981 Broussard et al. ..... 405/158

(Continued)

FOREIGN PATENT DOCUMENTS

WO 2011027121 A1 3/2011

OTHER PUBLICATIONS

Creel, Prentice, et al., "Repairing pinhole casing leaks with Injectrol® and PermSeal® solutions," 7 pages.

(Continued)

*Primary Examiner* — Matthew Buck
(74) *Attorney, Agent, or Firm* — Craig Roddy; Conley Rose, P.C.

(57) ABSTRACT

A method of servicing hydrocarbon production equipment comprising locating at least a portion of a hydrocarbon flow conduit experiencing a loss of functionality; creating a port to access an interior flow bore of the hydrocarbon flow conduit; installing at least one piece of equipment proximate the access port, wherein the equipment has access to the interior flow bore via the access port; and placing a servicing composition into the conduit via the access port, wherein the servicing composition prevents the loss of materials from the interior of the hydrocarbon flow conduit to the surrounding environment.

22 Claims, 2 Drawing Sheets

(56) References Cited

U.S. PATENT DOCUMENTS

| | | | | | |
|---|---|---|---|---|---|
| 4,369,845 | A * | 1/1983 | Henson et al. | 166/298 |
| 4,386,806 | A * | 6/1983 | Axen et al. | 299/5 |
| 4,417,625 | A * | 11/1983 | Henson et al. | 166/387 |
| 4,507,440 | A * | 3/1985 | Engelhardt et al. | 525/218 |
| 4,754,810 | A * | 7/1988 | Bennett et al. | 166/277 |
| 4,947,935 | A * | 8/1990 | Sydansk | 166/295 |
| 4,995,461 | A * | 2/1991 | Sydansk | 166/295 |
| 5,123,487 | A * | 6/1992 | Harris et al. | 166/277 |
| 5,335,726 | A * | 8/1994 | Rodrigues | 166/295 |
| 5,358,051 | A * | 10/1994 | Rodrigues | 166/295 |
| 5,377,757 | A * | 1/1995 | Ng | 166/277 |
| 5,836,392 | A * | 11/1998 | Urlwin-Smith | 166/295 |
| 6,192,986 | B1 * | 2/2001 | Urlwin-Smith | 166/295 |
| 6,196,317 | B1 * | 3/2001 | Hardy | 166/295 |
| 6,408,944 | B1 * | 6/2002 | Niinivaara et al. | 166/298 |
| 6,450,260 | B1 * | 9/2002 | James et al. | 166/277 |
| 7,306,039 | B2 * | 12/2007 | Wang et al. | 166/300 |
| 7,380,603 | B2 * | 6/2008 | Jeffrey et al. | 166/285 |
| 7,527,095 | B2 * | 5/2009 | Bloess et al. | 166/265 |
| 7,650,944 | B1 * | 1/2010 | Boyle | 166/344 |
| 8,136,597 | B2 | 3/2012 | Calderoni et al. | |
| 8,215,405 | B1 * | 7/2012 | Carrascal | 166/363 |
| 2003/0183389 | A1 * | 10/2003 | Lord et al. | 166/300 |
| 2006/0144591 | A1 * | 7/2006 | Gonzalez et al. | 166/277 |
| 2007/0187098 | A1 * | 8/2007 | Putzig | 166/295 |
| 2011/0056685 | A1 | 3/2011 | Ezell et al. | |
| 2011/0056697 | A1 * | 3/2011 | Calderoni et al. | 166/363 |

OTHER PUBLICATIONS

Foreign communication from a related counterpart application—International Preliminary Report on Patentability, PCT/GB2010/001670, Mar. 6, 2012, 7 pages.

Foreign communication from a related counterpart application—International Search Report and Written Opinion, PCT/GB2010/001670, Dec. 8, 2010, 10 pages.

Halliburton brochure entitled "The PermSeal® system," Mar. 2002, 2 pages.

Halliburton manual entitled "Water management—identification and treatment of water-control problems for improved reservoir recovery efficiency," Dec. 2002, 175 pages.

McGinn, Paul, et al., "Terminology, evaluation methods, candidate selection, and expectations of chemical systems for water and gas control," Apr. 2004, 2nd Produced Water Workshop, pp. 1-17.

Notice of Allowance dated Jul. 17, 2012 (5 pages), U.S. Appl. No. 12/544,707, filed Sep. 4, 2009.

Office Action dated Nov. 28, 2011 (17 pages), U.S. Appl. No. 12/554,707, filed Sep. 4, 2009.

Office Action (Final) dated May 2, 2012 (10 pages), U.S. Appl. No. 12/554,707, filed Sep. 4, 2009.

Sweatman, Ron, et al., "New fluids and processes stabilize wellbores during drilling operations for lower-cost well construction and enhanced production," AADE Annual Technical Forum—Improvements in Drilling Fluids Technology, Mar. 1999, pp. 1-19.

* cited by examiner

WELLBORE SERVICING COMPOSITIONS AND METHODS OF MAKING AND USING SAME

CROSS-REFERENCE TO RELATED APPLICATIONS

This application is a divisional of and claims priority to U.S. patent application Ser. No. 12/544,707 filed on Sep. 4, 2009, published as U.S. 2011/0056685 A1 and entitled "Wellbore Servicing Compositions and Methods of Making and Using Same," which is hereby incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

1. Technical Field

The present disclosure generally relates to servicing a wellbore. More particularly, this disclosure relates to servicing a wellbore with compositions comprising a gelation system and a brine and Methods of making and using same.

2. Background

Natural resources such as gas, oil, and water residing in a subterranean formation or zone are usually recovered by drilling a wellbore down to the subterranean formation while circulating a drilling fluid in the wellbore. After terminating the circulation of the drilling fluid, a string of pipe, e.g., casing, is run in the wellbore. The drilling fluid is then usually circulated downward through the interior of the pipe and upward through the annulus, which is located between the exterior of the casing and the walls of the wellbore. Subsequently, oil or gas residing in the subterranean formation may be recovered by driving the fluid into the well using, for example, a pressure gradient that exists between the formation and the wellbore, the force of gravity, displacement of the fluid using a pump or the force of another fluid injected into the well or an adjacent well.

In some cases, those wellbores and the components thereof (e.g., pipelines, etc.) may experience structural damage (e.g., tangled, bent, etc) that renders such components unable to function as intended. For example, the pipes in a wellbore may experience structural damage that limits the accessibility of a user to the fluid within the pipes. In instances where structural damage limits the accessibility of the user to the fluids within a subterranean formation, a damaged well intervention operation may be carried out prior to cleanup in order to recover the trapped fluid. Thus, it would be desirable to develop a methodology to recover the trapped fluids from structurally damaged wellbores.

SUMMARY

Disclosed herein is a method of servicing hydrocarbon production equipment comprising locating at least a portion of a hydrocarbon flow conduit experiencing a loss of functionality; creating a port to access an interior flow bore of the hydrocarbon flow conduit; installing at least one piece of equipment proximate the access port, wherein the equipment has access to the interior flow bore via the access port; and placing a servicing composition into the conduit via the access port, wherein the servicing composition prevents the loss of materials from the interior of the hydrocarbon flow conduit to the surrounding environment.

Also disclosed herein is a method of servicing hydrocarbon production equipment comprising creating an access port on a hydrocarbon flow conduit, wherein the hydrocarbon flow conduit is in fluid communication with a hydrocarbon well and hydrocarbons are leaking from the hydrocarbon flow conduit to a surrounding environment; connecting a servicing manifold to the access port, wherein the servicing manifold allows for the transfer of material to and from the wellbore conduit; connecting a servicing conduit to the servicing manifold; and placing a servicing composition within the hydrocarbon flow conduit via the servicing conduit, servicing manifold, and access port while simultaneously removing hydrocarbons from the hydrocarbon flow conduit via the access port, servicing manifold, and servicing conduit.

Also disclosed herein is a method of servicing a wellbore comprising introducing a composition comprising a crosslinkable material, an initiator, and a brine to a structurally damaged wellbore servicing component; and allowing the composition to form a gel, wherein the structurally damaged wellbore servicing component no longer functions to control a flow of fluids from the wellbore to a surrounding environment and wherein the gel prevents the flow of fluids from the structurally damaged wellbore servicing component to the surrounding environment.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
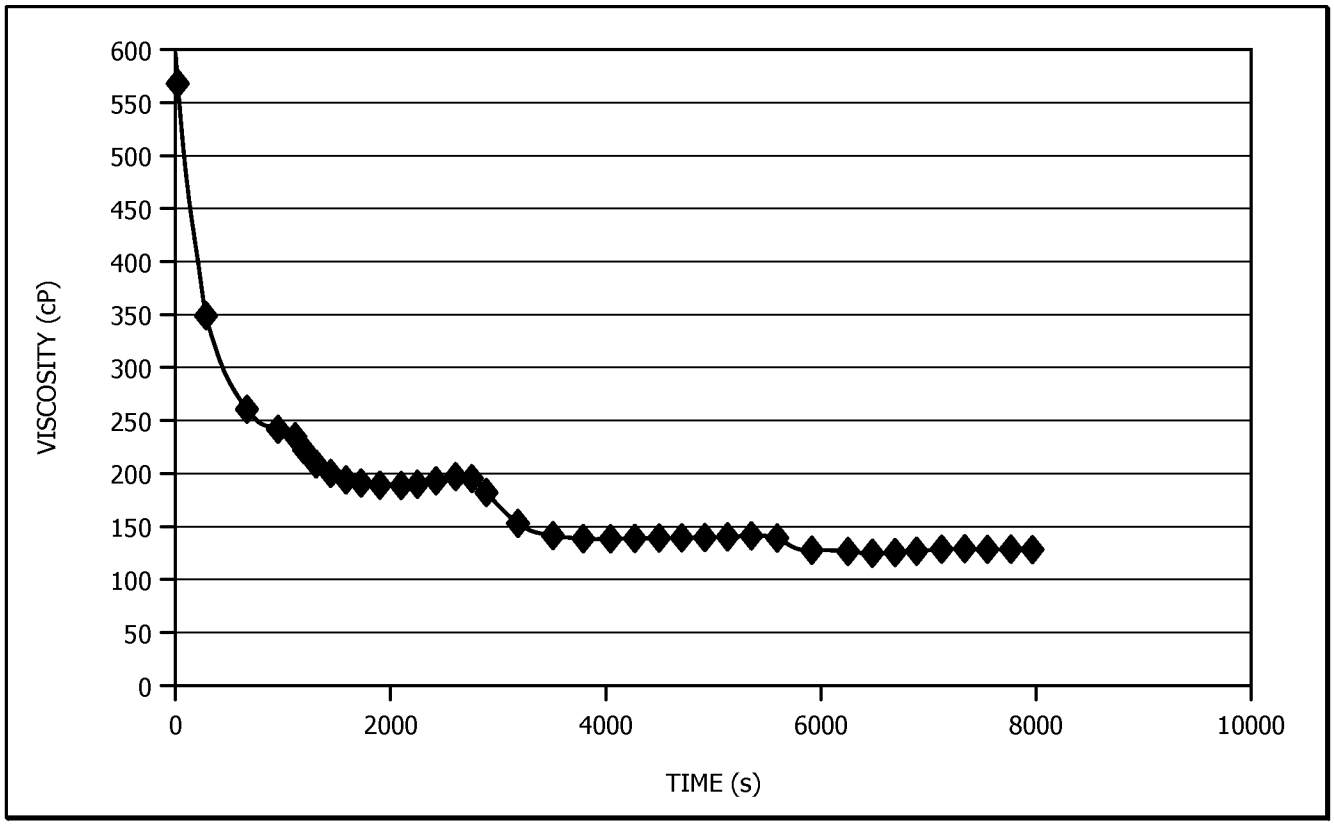
FIG. 1 is a plot of viscosity as a function of time for Sample 8 from Example 2.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are compositions (e.g., wellbore or hydrocarbon flow conduit servicing compositions) comprising a gelation system (GS) and brine. Such compositions are referred to as gelation systems in brines (GSBs). Generally, the GS comprises one or more crosslinkable materials and an initiator. The GSB may set at various temperature ranges to form a gel having a viscosity that may be useful in various wellbore servicing operations. For example, the GSB may be placed in a wellbore to create an overbalanced condition. As used herein, a gel is defined as a crosslinked polymer network in a liquid medium. The components of the GSB and methods of making and using same will be described in more detail later herein.

In an embodiment, the GSB comprises a GS comprising one or more crosslinkable materials and an initiator.

Examples of suitable crosslinkable materials include, but are not limited to, the following: (i) a water soluble copolymer of a non-acidic ethylenically unsaturated polar monomer and a copolymerizable ethylenically unsaturated ester; (ii) a terpolymer or tetrapolymer of a non-acidic ethylenically unsaturated polar monomer, an ethylenically unsaturated ester, and a monomer selected from 2-acrylamido-2-methylpropane sulfonic acid, N-vinylpyrrolidone, or both; or (iii) combinations thereof. The copolymer may comprise from one to three polar monomers and from one to three unsaturated esters.

The non-acidic ethylenically unsaturated polar monomers used in the crosslinkable material may comprise amides, e.g., primary, secondary, and/or tertiary amides, of an unsaturated carboxylic acid. Such amides may be derived from ammonia, or a primary or secondary alkylamine, which may be optionally substituted by at least one hydroxyl group as in alkylol amides such as ethanolamides. Examples of carboxylic acid derived ethylenically unsaturated polar monomers include without limitation acrylamide, methacrylamide, acrylic ethanol amide, or combinations thereof.

The ethylenically unsaturated esters used in the crosslinkable material may be formed from a hydroxyl compound and an ethylenically unsaturated carboxylic acid. Nonlimiting examples of ethylenically unsaturated carboxylic acids include acrylic, methacrylic, crotonic, and cinnamic acids, or combinations thereof. The ethylenically unsaturated group may be in the alpha-beta or beta-gamma position relative to the carboxyl group, alternatively it may be at a further distance. In an embodiment, the hydroxyl compound is an alcohol generally represented by the formula ROH, wherein R is an alkyl, alkenyl, cycloalkyl, aryl, arylalkyl, aromatic, or heterocyclic group that may be substituted with one or more of a hydroxyl, ether, or thioether group. The substituent can be on the same carbon atom of the R group as is bonded to the hydroxyl group in the hydroxyl compound. The hydroxyl compound may be a primary, secondary, iso, or tertiary compound. In an embodiment, a tertiary carbon atom is bonded to the hydroxyl group, e.g., t-butyl and trityl. In another embodiment, the ethylenically unsaturated ester is t-butyl acrylate.

Additional examples of suitable crosslinkable materials include but are not limited to self-crosslinking, water-soluble, hydroxy unsaturated carbonyl monomers and water-soluble vinyl monomers.

Suitable hydroxy unsaturated carbonyls are generally represented by the formula:

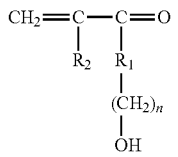

wherein $R_1$ is —O— or

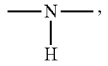

$R_2$ is hydrogen or —$CH_3$, and n is 1 or 2.

Nonlimiting examples of hydroxyl unsaturated carbonyl compounds suitable for use in this disclosure include hydroxyethylacrylate, N-hydroxymethylacrylamide, N-hydroxymethyl methacrylamide, hydroxyethylmethacrylate, hydroxymethylacrylate, hydroxymethylmethacrylate, N-hydroxyethylacrylamide, N-hydroxyethylmethacrylamide, or combinations thereof. Nonlimiting examples of water soluble vinyl monomers include acrylamide, methacrylamide, and acrylic acid. In an embodiment, the crosslinkable material comprises 2-hydroxylethylacrylate. In an embodiment, the crosslinkable material may be present in the GSB in an amount of from about 0.1 vol. % to about 20 vol. % by weight of the GSB, alternatively from about 0.5 vol. % to about 20 vol. %, alternatively from about 1 vol. % to about 15 vol. %.

In some embodiments, the GS further comprises a crosslinking agent. As used herein, a crosslinking agent physically crosslinks polymer chains through the formation of molecular links or bonds between points along the chains. Without wishing to be limited by theory, the physical interference between the crosslinking molecules and the polymer chains allows less movement of the chains, making the overall substance more solid. The crosslinking agent may be, for example, an organic crosslinking agent such as a polyalkyleneimine, a polyfunctional aliphatic amine such as polyalkylenepolyamine, an aralkylamine, a heteroaralkylamine, or combinations thereof. Examples of suitable polyalkyleneimines are polymerized ethyleneimine and propyleneimine. Examples of suitable polyalkylenepolyamines are polyethylene- and polypropylene-polyamines. A description of such crosslinking agents can be found in U.S. Pat. Nos. 5,836,392, 6,192,986, and 6,196,317, each of which is incorporated by reference herein in its entirety.

The crosslinking agent may be present in the GSB in an amount of from about 0.01 wt. % to about 20 wt. % by weight of the GSB, alternatively from about 0.05 wt. % to about 10 wt. %, alternatively from about .05 wt. % to about 5 wt. %.

In an embodiment, the GS comprises an initiator. The initiator may include any suitable initiator such as azo initiators, peroxide initiators, persulfate initiators, and the like. As used herein, an initiator is defined as a compound that is capable of forming free radicals that initiate polymerization. In an embodiment, the initiator is thermally activated. The thermally activated initiator may decompose to form free radicals within a defined temperature range. This feature may allow the initiator to become functional and initiate the crosslinking of the monomers under specific temperature conditions to meet some user and/or process desired need. For example, the initiator may be chosen to decompose within a temperature range of from about 90° F. to about 170° F., alternatively from about 90° F. to about 120° F., alternatively from about 120° F. to about 140° F., alternatively from about 140° F. to about 170° F. An alternative metric for selecting an appropriate initiator to employ in a particular wellbore servicing operation is based on the ten-hour half-life of the initiator. Specifically, an initiator may be chosen based on the temperature at which the original initiator content is reduced by 50% after ten hours. In an embodiment, the initiator has a ten-hour half life temperature of 90° F., alternatively 100, 110, 120, 130, 140, 150, 160, 170, 180, or 190° F.

Initiators suitable for use in this disclosure include azo compounds generally represented by the formula:

wherein Z is

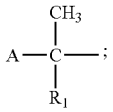

B is Z or $R_2$;

$R_1$ is —$CH_3$ or —C≡N;

A is

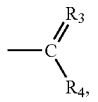

—$(CH_2)_2COOH$, or —$CH_3$;
$R_2$ is

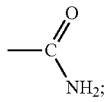

$R_3$ is =N—, =NH, or =O; and
$R_4$ is

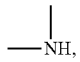

—$NH(CH_2)_2OH$, —$NHC(CH_2OH)_2CH_3$, or —$NHC(CH_2OH)_3$,
wherein $R_4$ is

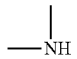

when $R_3$ is =N—, and
wherein $R_1$ is —C≡N and A is —$CH_3$ when B is $R_2$.

Examples of azo initiators suitable for use in this disclosure include without limitation 2,2'-azobis(2-amidinopropane)dihydrochloride, 2,2'-azobis(N,N'-dimethylene isobutyramidine)dihydrochloride, and 2,2'-azobis[2-methyl-N-(2-hydroxethyl)propionamide]. In an embodiment, the initiators comprise V-50, V-501, or V-086, each of which is an azo initiator commercially available from Wako Chemicals.

In an embodiment, the initiator may be present in the GSB in an amount of from about 0.0001 wt. % to about 0.1 wt. % by weight of the GSB, alternatively from about 0.001 wt. % to about 0.1 wt. %, alternatively from about 0.01 wt. % to about 0.05 wt. %.

In an embodiment, the GS comprises a crosslinkable material and an initiator which may be present in a crosslinkable material:initiator ratio of from about 1000:1 to about 50:1, alternatively from about 900:1 to about 100:1, alternatively from about 500:1 to about 100:1. Further description of crosslinkable materials and initiators suitable for use in this disclosure, can be found in U.S. Pat. Nos. 5,358,051 and 5,335,726, each of which is incorporated by reference herein in its entirety.

In an embodiment, the crosslinkable material is 2-hydroxyethylacrylate, and the initiators used therewith are azo-compounds of the type described herein. In an embodiment the crosslinkable materials comprise the PERMASEAL system which is a chemical sealant commercially from Halliburton Energy Services.

In an embodiment, the GSB comprises one or more brines. The brines may be any suitable saturated or a nearly saturated saltwater solution. For example, the brine may be any suitable saturated or a nearly saturated salt solution comprising water and greater than about 90, 95, 99, or 99.9 wt. % salt. Examples of brines suitable for use in this disclosure include without limitation solutions of sodium bromide (NaBr), calcium bromide ($CaBr_2$), zinc bromide ($ZnBr_2$), potassium bromide (KBr), sodium chloride (NaCl), calcium chloride ($CaCl_2$), zinc chloride ($ZnCl_2$), potassium chloride (KCl), sodium nitrate ($NaNO_3$), calcium nitrate ($Ca(NO_3)_2$), zinc nitrate ($Zn(NO_3)_2$), potassium nitrate ($KNO_3$), sea salt, formate brines comprising compounds such as potassium formate, cesium formate, sodium formate and the like or combinations thereof. In an embodiment, the brine consists of less than about 10 vol. % of a formate compound.

In an embodiment, the brine may have a density of from about 8.345 lbs/gal to about 19.2 lbs/gal, alternatively from about 9 lbs/gal to about 16 lbs/gal, alternatively from about 10 lbs/gal to about 14.2 lbs/gal. The brine may be present in the GSB in an amount of from about 0.001 vol. % to about 99.999 vol. % by volume of the GSB, alternatively from about 0.5 vol. % to about 99.5 vol. %, alternatively from about 1 vol. % to about 99 vol. %.

In an embodiment, a GS comprising a crosslinkable material and an initiator may be contacted with one or more brines in the amounts previously described herein to form a gel. The pH of the composition may be adjusted to fall within a range that meets some user and/or process desired need. For example, the pH of the composition may be adjusted to facilitate gelation within a user and/or process desired time frame. In an embodiment, the pH may be adjusted to a range of from about 4.5 to about 7.0, alternatively from about 4.5 to about 6.5, alternatively from about 4.5 to about 6.0. Adjustment of pH may be carried out by contacting the gel with any suitable buffer solution, for example an acetic acid buffer solution. Without wishing to be limited by theory, a crosslinkable material (e.g., 2-hydroxyethylacrylate) in the presence of one or more brines and an initiator (e.g., an azo compound) at a pH range as described herein may polymerize at wellbore temperatures to form a gel, as illustrated in Scheme 1. Wellbore temperatures may be in the range of from about 50° F. to about 300° F., alternatively from about 75° F. to about 275° F., alternatively from about 100° F. to about 250° F.

Scheme 1

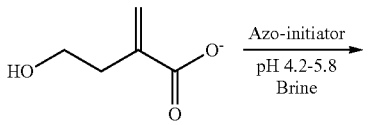

2-hydroxyethylacrylate

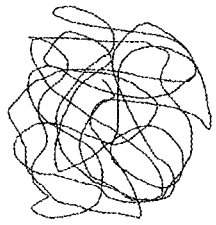

Gel

In an embodiment, the GSB has a mixture viscosity that may be characterized as "water-thin" wherein the mixture viscosity is substantially similar to that of water at standard room temperature and pressure. For example, the GSB may have a mixture viscosity of from about 1 cp to about 10 cp; alternatively from about 1 cp to about 8 cp; alternatively from about 1 cp to about 5 cp. Viscosity is a measure of the resistance of a fluid which is being deformed by shear stress. Herein mixture viscosity refers to the viscosity of the mixture upon contact and at ambient temperature in the time period of from mixing to less than about 1 hour after mixing. A GSB having a mixture viscosity in the range described herein may be advantageous in the placement of the material under challenging conditions as will be described in more detail later herein.

In an embodiment, the GSB may be compatible with crude oil such that the reactants of the GSB when contacted with crude oil remain in the aqueous phase. In such an embodiment, when crude oil is present along with the components of the GSB, the components of the GSB retain the ability to form a gel having the properties and ability to function in wellbore servicing as described herein.

In an embodiment, the GSB forms a gel exhibiting appreciable gel strength and able to perform the wellbore services described herein when exposed to an elevated temperature. In an embodiment, an appreciable gel strength is equal to or greater than about 150 cp, alternatively equal to or greater than about 250 cp. In such embodiments, the GSB may be said to be cured and curing may be carried out at a temperature of from about 50° F. to about 300° F., alternatively from about 75° F. to about 275° F., alternatively from about 80° F. to about 250° F.

GSBs of the type described herein may be characterized by an adjustable gel time, an adjustable viscosity, or combinations thereof. The gel time may be adjusted by varying any number of factors such as for example the amount of crosslinkable material, the ratio of crosslinkable material: initiator, half-life of the initiator, amount of brine in the composition and the like. For example, the GSB may be adjusted so as to begin forming a gel at a particular wellbore depth coincident with a particular temperature or temperature range, in a particular pH range, or combinations thereof.

As will be understood by one of ordinary skill in the art, the GSB may begin to polymerize to some extent at a temperature or pH outside the disclosed ranges. However, the degree of polymerization will be only partial and will not result in the formation of a gel having appreciable gel strength and unable to perform the wellbore services described herein. Hereinafter it is to be understood the properties disclosed for an unpolymerized GSB may also be exhibited by a partially polymerized GSB.

As described previously, the cured GSB may be characterized by a viscosity that differs from that of the mixture viscosity. For example, the cured GSB may have a viscosity of from about 100 cp to about 1,000,000 cp, alternatively from about 150 cp to about 100,000, alternatively from about 150 cp to about 10,000 cp. An advantage of the present disclosure is that one of ordinary skill in the art with the benefits of this disclosure may formulate a cured GSB having a user and/or process desired viscosity. Such methods of adjusting the viscosity of the cured GSB have been described previously herein. Thus the cured GSB may display characteristics varying from an elastic gel to a rigid gel. The ability to adjust or tune the viscosity of the GSB may allow a user to select an appropriate GSB based on the needs of a wellbore and its processing requirement. The viscosity of the GSB may also be adjusted by modifying the selection of and/or ratio of crosslinkable material: initiator, temperature, shear rate, etc. For example, the GSB may be optimized to have a viscosity suitable for use in remedial services of damaged pipe of a wellbore at a higher depth or at an elevated temperature. In some cases, the fluid will achieve increased viscosity yet maintain a flowing form so that the proper hydrostatic pressure can be maintained.

In an embodiment, the cured GSB retains some degree of fluidity and displays desirable rheological behavior. For example, when the cured GSB is sheared and/or heated, the GSB may display shear thinning behavior (i.e., the viscosity of the cured GSB decreases).

In an embodiment, the cured GSB may display thermal stability. Thermal stability refers to the ability of the GSB to maintain a viscosity in the range described herein for a time period of from about 1 day to about 5 years, alternatively from about 1 day to about 365 days, alternatively from about 1 day to about 180 days at a temperature of equal to or less than about 300° F., alternatively from about 50° F. to about 275° F., alternatively from about 80° F. to about 250° F.

In an embodiment, the cured GSB may be further characterized by an inability to adhere to the components of the wellbore and become self-supporting. For example, the cured GSB may not adhere to or bind to the walls of a casing of the wellbore. In such embodiments, the cured GSB maintains hydrostatic pressure within the wellbore (for example, preventing the flow of fluids from the wellbore to the surface). The degree of adhesion of the GSB may be measured by any suitable methodology such as gravimetric analysis. In an embodiment, the degree of adhesion of the GSB is measured by standard pipe accretion testing. In an embodiment, the degree of adhesion of the GSB is less than about 0.10 wt. %, alternatively less than about 0.05 wt. %, alternatively equal to or less than about 0.01 wt. %. Further, the cured GSB may be easily removed from the wellbore during a wellbore clean up operation. Such cleanup methods may include washing with mutual solvent or the addition of chemical breakers to reduce the viscosity.

In an embodiment, GSBs of the type described herein may be placed downhole to service a wellbore. For example, the GSBs may be used in damaged well intervention, lost circulation zone treatments, as a kill pill or combinations thereof. In an embodiment, the GSB is cured to form a gel of appreciable gel strength in the absence of crude oil. Alternatively, the GSB is cured to form a gel of appreciable gel strength in the presence of crude oil. In an alternative embodiment, the GSB is cured/gelled prior to placing the material in a desired location. Alternatively, the GSB may be formulated so as to allow partial polymerization of the gel such that the gel before placement at a desired location has a viscosity greater than water at standard temperature and pressure.

In an embodiment, the GSB may be placed downhole and cured to create an overbalanced condition wherein the amount of pressure in the wellbore exceeds the pressure of fluids in the formation. An overbalanced condition in the wellbore is beneficial for preventing the wellbore from collapsing as well as preventing fluid such as hydrocarbon from entering into the wellbore.

In an embodiment, GSBs of the type described herein may be used to reduce adverse events associated with damage to hydrocarbon production equipment used in wellbore servicing operations. For example, the GSB may be placed in a conduit that has been compromised structurally. Such conduits may be damaged due to any cause, for example, as a result of extreme conditions or natural disasters (e.g., hurricanes, tornadoes, and earthquake).

In an embodiment, a wellbore servicing operation comprises hydrocarbon production equipment that has been compromised structurally. In such an embodiment, the hydrocarbon production equipment no longer functions as intended. For example, the hydrocarbon production equipment may comprise one or more conduits that allow for the transfer of material (e.g., hydrocarbon fluid) from a wellbore to a surface. In an embodiment, at least one of the conduits and/or a portion of a conduit utilized in the transfer of hydrocarbons from the wellbore to the surface is displaced from its original location such that the conduit is no longer in fluid communication with the remainder of the hydrocarbon production equipment. Structural compromise of the conduit may allow for the uncontrolled flow of hydrocarbons from the wellbore to the surrounding environment. Additionally, access to the conduit through traditional methods may be restricted or unavailable, for example, a structurally damaged underwater conduit may be located or bent down below the mud line. In such embodiments, the GSBs may be used to "kill" structurally compromised conduits that allow for the uncontrolled flow of fluids (e.g., hydrocarbons) from a wellbore to the surrounding environment. Hereinafter such conduits are referred to as "damaged conduits." Killing the conduit herein refers to reducing or preventing the uncontrolled flow of fluid from the damaged conduit to the surrounding environment.

In an embodiment, a method of killing a damaged conduit comprises locating the damaged conduit, creating a means of accessing the damaged conduit, establishing fluid communication with the damaged conduit and introducing a wellbore servicing composition to the conduit that prevents and/or reduces the unwanted flow of material from the conduit to the surrounding environment. Hereinafter the disclosure will focus on a damaged conduit that was and/or is in fluid communication with a subsea wellbore, for example subsea well conduit that has been damaged by a hurricane.

In an embodiment, the method comprises locating the damaged conduit. For example, the damaged conduit may be located among debris and/or other wellbore servicing equipment that has been displaced from its original location in the hydrocarbon production operation. Location of the damaged conduit may be carried out using automated devices such as radar, sonar, GPS, and/or remotely operated underwater vehicles (ROVs) having cameras to visualize areas having potentially damaged conduits. Further, automated equipment may be used to gather data such as the extent of damage to the conduit, the amount of fluid flowing from the damaged conduit to the surrounding environment, the rate of fluid flow from the damaged conduit to the surrounding environment, the rate of flow of material to the damaged conduit, the pressure within the damaged conduit and the like. Additionally and/or alternatively divers and/or other submersibles (such as submarines) may be deployed to locate the damaged conduit and gather data of the type described herein.

The method may further comprise creating a means of accessing the damaged conduit. The damaged conduit may be accessed by creating a port that extends from the exterior of the damaged conduit to the interior flow bore of the conduit. For example, a means of accessing the damaged conduit may comprise drilling or cutting a hole in the damaged conduit wall. The access port may be created manually such as by divers using a means of drilling or may be created using an automated device or ROV.

The method may further comprise establishing fluid communication with the damaged conduit by installing at least one piece of equipment (e.g., a connection/access assembly) proximate to the access port wherein the equipment provides access to the interior flow bore within the damaged conduit. Any suitable connection/access assembly may be employed. Such equipment may be used to provide materials to the damaged conduit, remove materials from the damaged conduit, monitor the conditions of the damaged conduit, adjust the pressure of the damaged conduit, or combinations thereof. In an embodiment, the equipment comprises valves, pumps, transfer conduits, tubing and the like that may be used to establish a controllable flow path from the interior flowbore of the damaged conduit to one or more vessels exterior to the damaged conduit. The method may further comprise installing sensors on the damaged conduit collocated with or proximate to the equipment. Such sensors are known to one of ordinary skill in the art and may be utilized in gathering and/or transmitting data on the conditions of the environment surrounding the damaged conduit, the conditions of the damaged conduit and the like. Further, the sensors may provide a means of controlling equipment installed on the damaged conduit.

In an embodiment, the method further comprises installing a servicing conduit that allows for fluid communication from the interior flowbore of the damaged conduit to one or more service vessels, devices, and/or other conduits on the exterior of the damaged conduit. For example, the servicing conduit may be coupled to the equipment installed on the access port (e.g., an access assembly) such that material (e.g., hydrocarbon fluid) flows from the interior of the damaged conduit through the servicing conduit to a user and/or process desired destination (e.g., a surface vessel for recovery). In an embodiment, the servicing conduit is a high pressure flow line, for example the dimensions of the flow line may be from about ½" to about 10" depending on a variety of factors such as for example well conditions. The high pressure flow line may be deployed from a surface vessel to the equipment installed on the damaged conduit. The high pressure flow line may be coupled to the equipment either manually or automatically and function to allow the transfer of materials from the interior flow bore of the damaged conduit to the surface vessel and/or from the surface vessel to the interior flow bore of the damaged conduit. The transfer of materials may be automated, manual, or combinations thereof. In an embodiment, materials may be transferred simultaneously from the service conduit to the interior flow bore of the damaged conduit and from the interior flow bore of the damaged conduit to the service conduit, which is sometimes referred to as "bullheading."

In an embodiment, the method further comprises removing at least a portion of the material from the interior flow bore of the damaged conduit via the servicing conduit. The amount of material to be removed may be determined by one of ordinary skill in the art with the aid of this disclosure based on any number of user and/or process-desired needs. The method may further comprise introducing a GSB of the type described herein to the interior flow bore of the damaged conduit via the servicing conduit. Introduction of the GSB to the interior flow bore of the damaged conduit via the servicing conduit may be prior to, concomitant with, and/or subsequent to the removal of material from the interior flow bore of the damaged conduit via the servicing conduit. The rate of introduction of the GSB may be at any rate compatible with the methodology and consistent with the structurally integrity of the damaged conduit. For example, transfer of the GSB to the pipeline may be carried out at a flow rate of from about ¼ bbl/min to about 25 bbl/min, alternatively from about 0.5 bbl/min to about 25 bbl/min, alternatively from about 1 bbl/min to about 20 bbl/min. The use of a water-thin GSB (i.e., a viscosity of from about to about 10 cp) may be advantageous so as to facilitate the flow of the GSB into the interior of the damaged conduit. The method may further comprise curing of the GSB so as to form a gel of appreciable gel strength. The gelled/cured GSB may function to create an overbalanced condition that does not further compromise the damaged conduit and/or formation structurally and prevents the unwanted flow of fluids from the damaged conduit into the surrounding environment. In addition, the gel may have sufficient strength to prevent itself from escaping through the access port. The GSB may not adhere appreciably to the pipeline or formation such that the GSB may be easily removed during wellbore clean up.

In an embodiment, the method further comprises assessing the flow of materials from the damaged conduit, the condition of the damaged conduit and the like subsequent to gelation of the GSB. For example, the worksite may be monitored to confirm that hydrocarbon releases to the environment are prevented, reduced, or eliminated.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner. In the following examples the pH of the compositions were adjusted using an acetic acid buffer at a pH of 4 and the compositions had a final pH between 4.8 and 6.2. The initiator used in each example was V-50 which is an azo initiator commercially available from Wako Chemicals.

Example 1

Kinetic studies of GSBs with varying monomer concentration were investigated. Seven samples, designated Samples 1-7, were prepared using 2-hydroxyethylacrylate as the monomer and 14 ppg $CaBr_2/CaCl_2$ brine. The monomer concentration of Samples 1-7 were 13.0, 11.5, 9.0, 8.7, 8.4, 7.5, and 6% by volume, respectively. The pH of the mixtures was adjusted and then 0.15 lb/bbl of V-50 was added to each sample. The samples were then capped and placed in an oven for 100 minutes at 140° F. to gel.

The results demonstrated that a full strength gel was achieved at a monomer concentration of 13% by volume. Varying degrees of polymerization and crosslinking were then derived by decreasing the monomer content and maintaining the monomer:initiator ratio. Optimum gel formation (e.g., gel strength about 150 cp) was observed in Sample 4 (i.e., 8% by volume of monomer concentration) at 60% of the full strength gel. Herein a full strength gel refers to the gel formed when the crosslinking reaction has gone to equal to or greater than 98% completion.

Example 2

The rheological properties of a GSB were investigated. Sample 8 was prepared by mixing 0.085 bbl of 2-hydroxyethylacrylate with 0.92 bbl of 14 ppg $CaBr_2/CaCl_2$ brine in a bottle. The pH of the mixture was adjusted and then 0.15 lb/bbl of V-50 azo initiator was added. The bottle was then capped and placed in an oven for 100 minutes at 140° F. to allow for gelation to occur. Rheology tests were performed on the gel using a Fann 50 viscometer. The results are shown in FIG. 1.

At a temperature of about 70° F., the gel was substantial but did flow with noticeable lipping behavior, which is typically associated with viscoelastic fluid. As the gel was heated and sheared at 170 $sec^{-1}$, its viscosity began to decrease as expected. A typical desirable viscosity of 150 cP was achieved at 190° F.

Example 3

GSBs comprising various brines were prepared and their ability to gel in the presence of crude oil was investigated. Four samples, designated Samples 9-12, were prepared by mixing 2-hydroxyethylacrylate with chloride and bromide brines comprising $Ca^{2+}$, $Zn^{2+}$, $K^+$, and $Na^+$ respectively. The density of the various brines ranged from 8.5 to 19 ppg. The pH of the mixtures were adjusted and then 0.15 lb/bbl of V-50 were added to each sample. Finally, 50 vol. % of crude oil was added to each sample. The samples were then capped and placed in an oven for 100 minutes at 140° F. to allow for gelation to occur. The samples were then visually observed.

For each sample, the heavier fluid phase (i.e. GSB) moved towards the bottom of the bottle and set as a gel as the oil phase moved toward the top of the bottle and did not appear to interact with the gel. In addition, once the gelation of each sample was completed, the oil could not move through to penetrate the gel, which suggests that the gel acts as a chemical cap.

Example 4

The thermal stability of a GSB was investigated. A sample, designated Sample 13, was prepared by mixing 0.085 bbl of 2-hydroxyethylacrylate with 0.92 bbl of 14 ppg $CaBr_2/CaCl_2$ brine in a bottle. The pH of the mixture was adjusted and then 0.15 lb/bbl of V-50 azo initiator was added. The bottle was then capped and placed in an oven for 100 minutes at 140° F. to allow for gelation to occur. Once gelation occurred, the temperature in the oven was increased to 190° F. and the sample was maintained at 190° F. for two weeks. During that time, the gel strength remained 150 cp at 150° F. and no loss in gel strength or viscosity was observed.

Example 5

Figure 2:
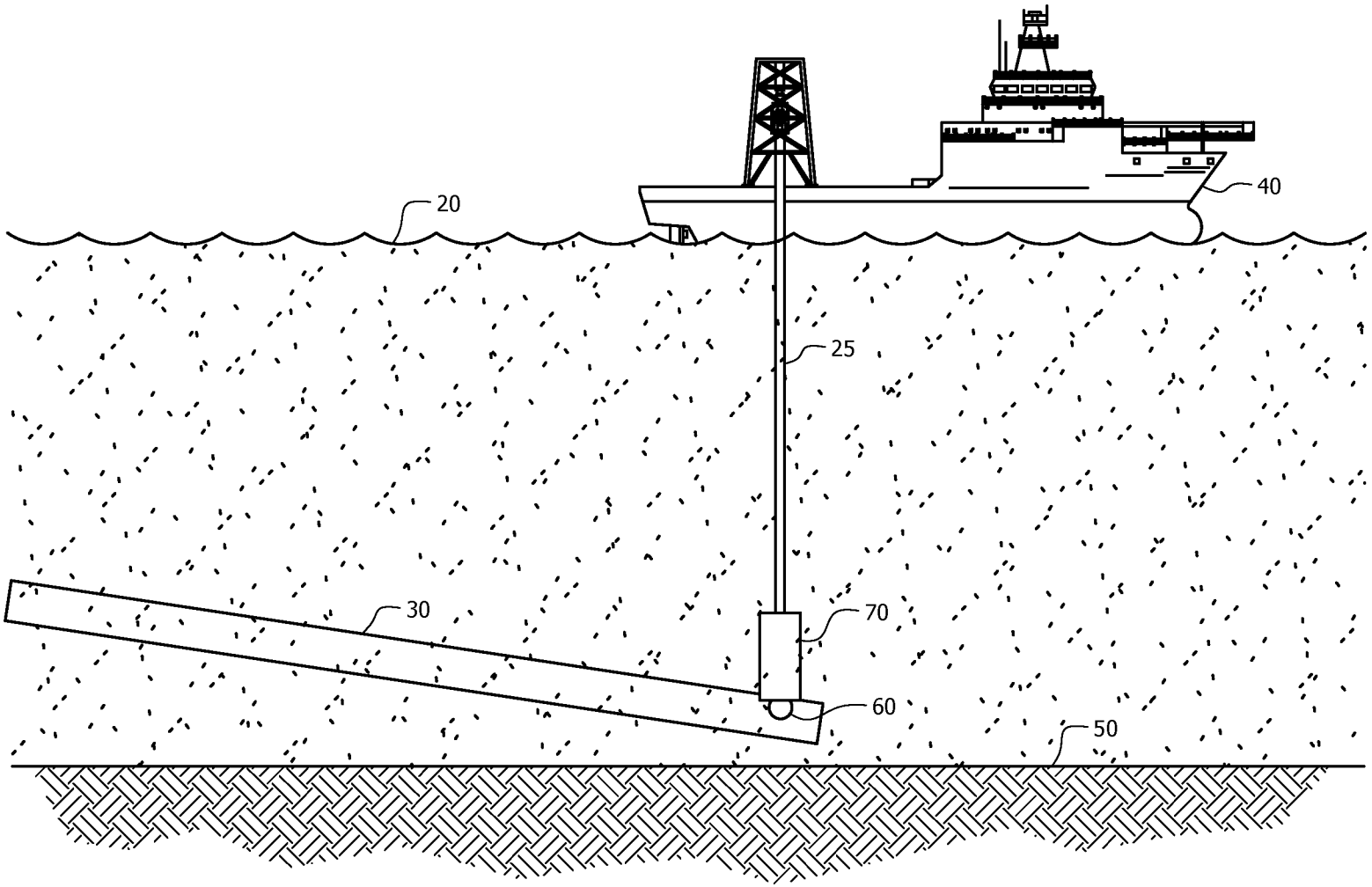
FIG. 2 is a schematic illustration of Example 5.

In a prophetic example a low pressure kill of a hydrocarbon producing pipeline may be carried out using a GSB of the type described herein. Referring to FIG. 2, an offshore pipeline 30 had been structurally compromised as a result of extreme weather conditions. The pipeline 30 was bent such that the pipeline 30 allowed for the uncontrolled flow of fluid from the interior of the pipeline 30 to the surrounding environment. At least a portion of the pipeline lay close to the mudline 50 below sea water 20. A repair boat 40 was deployed to create an access port 60 on the pipeline 30 to which was attached equipment 70 to facilitate the introduction and withdrawal of material from the access port 60 via conduit 25. The well was killed as described previously herein by the introduction of a GSB comprising a gel of the type described herein and $CaBr_2$ at 140 psi via conduit 25.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Whenever a numerical range with a lower limit and an upper limit is disclosed, any number and any included range falling within the range is specifically disclosed. In particular, every range of values (of the form, "about a to about b," or, equivalently, "from approximately a to b," or, equivalently, "from approximately a-b") disclosed herein is to be understood to set forth every number and range encompassed within the broader range of values. Use of the term "optionally" with respect to any element of a claim is intended to mean that the subject element is required, or alternatively, is not required. Both alternatives are intended to be within the scope of the claim. Use of broader terms such as comprises, includes, having, etc.

should be understood to provide support for narrower terms such as consisting of, consisting essentially of, comprised substantially of, etc. Also, the terms in the claims have their plain, ordinary meaning unless otherwise explicitly and clearly defined by the patentee.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method of servicing a wellbore penetrating a subterranean formation, comprising:

introducing a composition comprising a crosslinkable material, an initiator, and a brine to a structurally damaged wellbore servicing component; and allowing the composition to form a gel having a gel viscosity of 150 cp at a temperature in a range of 150° F. to 1.90° F., wherein the structurally damaged wellbore servicing component no longer functions to control a flow of fluids from the wellbore to a surrounding environment and wherein the gel prevents the flow of fluids from the structurally damaged wellbore servicing component to the surrounding environment.

2. The method of claim 1 wherein the introducing the composition to the structurally damaged wellbore servicing component comprises creating an overbalanced condition within the structurally damaged wellbore servicing component.

3. The method of claim 1 wherein the structurally damage wellbore servicing component is underwater.

4. The method of claim 1 wherein the composition cures to form the gel at a temperature of from about 50° F. to about 300° F.

5. The method of claim 1 wherein the composition has a mixture viscosity of from about 1 cp to about 10 cp.

6. The method of claim 4 wherein the gel forms in the presence of crude oil.

7. The method of claim 4 wherein the gel does not adhere to the wellbore and/or subterranean formation.

8. The method of claim 1 wherein the crosslinkable material comprises (i) a water soluble copolymer of a non-acidic ethylenically unsaturated polar monomer and a copolymerizable ethylenically unsaturated ester; (ii) a terpolymer or tetrapolymer of a non-acidic ethylenically unsaturated polar monomer, an ethylenically unsaturated ester, and a monomer selected from 2-acrylamido-2-methylpropane sulfonic acid, N-vinylpyrrolidone, or both; or (iii) combinations thereof.

9. The method of claim 8 wherein the non-acidic ethylenically unsaturated polar monomer is an amide of an unsaturated carboxylic acid.

10. The method of claim 9 wherein the amide of an unsaturated carboxylic acid comprises acrylamide, methacrylamide, acrylic ethanol amide, or combinations thereof.

11. The method of claim 8 wherein the ethylenically unsaturated esters are formed from a hydroxyl compound and an ethylenically unsaturated carboxylic acid.

12. The method of claim 11 wherein the ethylenically unsaturated carboxylic acid comprises acrylic acid, methacrylic acid, crotonic acid, cinnamic acid, or combinations thereof.

13. The method of claim 11 wherein the hydroxyl compound is an alcohol generally represented by the formula ROH, wherein R is an alkyl, alkenyl, cycloalkyl, aryl, arylalkyl, aromatic, or heterocyclic group.

14. The method of claim 1 further comprising a crosslinking agent selected from the group consisting of a polyalkyleneimine, a polyfunctional aliphatic amine, an aralkylamine, a heteroaralkylamine, and combinations thereof.

15. The method of claim 1 wherein the initiator is selected from the group consisting of azo initiators, peroxide initiators, persulfate initiators, and combinations thereof.

16. The method of claim 1 wherein the initiator comprises an azo initiators selected from the group consisting of 2,2'-azobis (2-amidinopropane) dihydrochloride, 2,2'-azobis (N,N'-dimethylene isobutyramidine) dihydrochloride, 2,2'-azobis [2-methyl-N-(2-hydroxethyl) propionamide], and combinations thereof.

17. The method of claim 1 wherein the crosslinkable material and the initiator are present in a crosslinkable material: initiator ratio of from about 1000:1 to about 50:1.

18. The method of claim 16 wherein the crosslinkable material is 2-hydroxyethylacrylate.

19. The method of claim 18 wherein the crosslinkable material is present in an amount of from about 0.1 wt. % to about 20 wt. % by weight of the composition and the initiator is present in an amount of from about 0.0001 wt. % to about 0.1 wt. % by weight of the composition.

20. The method of claim 1, wherein the structurally damaged wellbore servicing component comprises a damaged subsea well conduit.

21. The method of claim 13, wherein R is substituted with one or more of a hydroxyl, ether, or thioether group.

22. The method of claim 1, wherein the gel has a gel viscosity that decreases with shear rate and/or heating.

* * * * *

UNITED STATES PATENT AND TRADEMARK OFFICE

CERTIFICATE OF CORRECTION

PATENT NO. : 8,684,091 B2
APPLICATION NO. : 13/455019
DATED : April 1, 2014
INVENTOR(S) : Ryan G. Ezell et al.

It is certified that error appears in the above-identified patent and that said Letters Patent is hereby corrected as shown below:

In the Claims:

In Column 13, Claim 1, line 29, replace "1.90°F" with --190°F--.

Signed and Sealed this
Seventeenth Day of June, 2014

Michelle K. Lee

Michelle K. Lee
*Deputy Director of the United States Patent and Trademark Office*